US010820690B2

(12) United States Patent
Tao et al.

(10) Patent No.: US 10,820,690 B2
(45) Date of Patent: Nov. 3, 2020

(54) SYNCHRONOUS LIFTING MECHANISM

(71) Applicant: JIANGSU JELT LIFTING SYSTEM CO., LTD, Changzhou (CN)

(72) Inventors: Shengrong Tao, Changzhou (CN); Xiaogang Li, Changzhou (CN)

( * ) Notice: Subject to any disclaimer, the term of this patent is extended or adjusted under 35 U.S.C. 154(b) by 0 days.

(21) Appl. No.: 16/509,992

(22) Filed: Jul. 12, 2019

(65) Prior Publication Data

US 2020/0121072 A1 Apr. 23, 2020

(30) Foreign Application Priority Data

Oct. 18, 2018 (CN) ..... 2018 1 1213030

(51) Int. Cl.
*A47B 9/12* (2006.01)
*A47B 9/14* (2006.01)
*A47B 9/20* (2006.01)

(52) U.S. Cl.
CPC ..... *A47B 9/12* (2013.01); *A47B 9/14* (2013.01); *A47B 9/20* (2013.01); *A47B 2200/0052* (2013.01); *A47B 2200/0056* (2013.01)

(58) Field of Classification Search
CPC .... A47B 9/12; A47B 9/20; A47B 9/00; A47B 9/02; A47B 2020/0052; A47B 2020/0056
See application file for complete search history.

(56) References Cited

U.S. PATENT DOCUMENTS

| | | | | |
|---|---|---|---|---|
| 9,038,549 | B1 * | 5/2015 | Zebarjad | A47B 9/02 108/147 |
| 9,820,565 | B2 * | 11/2017 | Zebarjad | A47B 9/00 |
| 2009/0072101 | A1 * | 3/2009 | Stoelinga | F16H 19/06 248/188.5 |
| 2012/0227642 | A1 * | 9/2012 | Sekikawa | A47B 9/10 108/147 |
| 2016/0227921 | A1 * | 8/2016 | Hansen | A47B 9/02 |
| 2016/0296005 | A1 * | 10/2016 | Stoelinga | F16M 11/046 |
| 2018/0064241 | A1 * | 3/2018 | Tseng | F15B 15/1409 |
| 2018/0092457 | A1 * | 4/2018 | Lai | A47B 9/20 |
| 2019/0059572 | A1 * | 2/2019 | Moody | B25H 1/16 |
| 2020/0163451 | A1 * | 5/2020 | Tao | A47B 9/12 |

* cited by examiner

*Primary Examiner* — Daniel J Rohrhoff
(74) *Attorney, Agent, or Firm* — Bayramoglu Law Offices LLC

(57) ABSTRACT

The invention is about a synchronous lifting mechanism, with a first inner fixed tube and a second inner fixed tube and that the synchronous lifting mechanism has a synchronizing mechanism, the synchronizing mechanism include a first support of which one end is in clearance fit with the inside of the first inner fixed tube and a second support of which one end is in clearance fit with the inside of the second inner fixed tube.

9 Claims, 12 Drawing Sheets

SYNCHRONOUS LIFTING MECHANISM

CROSS-REFERENCE TO RELATED APPLICATIONS

This application claims priority to Chinese Patent Application No. 201811213030.5 with a filing date of Oct. 8, 2018. The content of the aforementioned applications, including any intervening amendments thereto, are incorporated herein by reference.

TECHNICAL FIELD

The present invention relates to a synchronous lifting mechanism.

BACKGROUND ART

A table as an article for daily use is common in life, work and school learning, a common table is generally formed by fixedly connecting a tabletop with table legs, the lengths of the table legs are also fixed, and thus, the height of the whole tabletop is fixed and cannot be adjusted. Along with difference of application environments and due to application demands of different people, requirements for height diversification, the degree of automation and the degree of comfort of the table are higher and higher.

Air springs have been used as the table legs of the table to support the tabletop at present, a control assembly for controlling each air spring to start or close is mounted on the lower surface of the tabletop, each control assembly is connected with a drag line connector (hinged to a connecting assembly) on the connecting assembly through components such as a drag line, the other end of each drag line connector is abutted against the switch of the corresponding air spring, when the table requires to ascend or descend, a user controls the control assemblies to apply power to the drag lines so as to enable the drag line connectors to rotate, thus, the switches of the air springs are turned on, and the air springs ascend or descend according to the intention of the user.

Because all the table legs at the two ends of the table are supported by the air springs, the air springs require to run synchronously when the table is controlled to lift, otherwise the tabletop will be inclined if one side ascends or descends but the other side does not move, for example, when the tabletop requires to descend, a control person applies large downward pressure to one end of the table and applies small downward pressure to the other end of the table, and in the circumstance, the tabletop is inclined most easily.

SUMMARY OF THE INVENTION

The present invention aims to provide a synchronous lifting mechanism and a table, and it can be ensured that a component supported on the synchronous lifting mechanism cannot be inclined.

The technical solution for solving the technical problem is as follows:

the synchronous lifting mechanism comprises a first inner fixed tube and a second inner fixed tube, and further comprises a synchronizing mechanism, the synchronizing mechanism comprises:

a first support of which one end is in clearance fit with the inside of the first inner fixed tube;

a second support of which one end is in clearance fit with the inside of the second inner fixed tube;

a power transmission component stretching across the first support and the second support, wherein one end of the power transmission component is connected with the other end of the first support, and the other end of the power transmission component is connected with the other end of the second support;

a first flexible traction component, wherein one end of the first flexible traction component is connected with the second inner fixed tube, and after the first flexible traction component is flexibly matched with one end of the second support, one end of the first support and the other end of the first support, the other end of the first flexible traction component is connected with the first inner fixed tube;

a second flexible traction component, wherein one end of the second flexible traction component is connected with the first inner fixed tube, and after the second flexible traction component is flexibly matched with one end of the first support, one end of the second support and the other end of the second support, the other end of the second flexible traction component is connected with the second inner fixed tube; and a driver arranged on the power transmission component, wherein the power output of the driver is connected with the first flexible traction component or the second flexible traction component; or at least one part of the driver is arranged in the first inner fixed tube, and the power output end of the driver is connected with the other end of the first support or the power transmission component or the first flexible traction component; or at least one part of the driver is arranged in the second inner fixed tube, and the power output end of the driver is connected with the other end of the second support or the power transmission component or the second flexible traction component.

The present invention has the advantages that: as long as the driver works, the flexible connection component which is connected with the output end of the driver can move, then power is transmitted to the corresponding support and the support drives the power transmission component to ascend or descend, the power transmission component drives the other support to ascend or descend, and the other support drives the other flexible traction component to move. Therefore, by the synchronous lifting mechanism of the present invention, synchronism of lifting of two ends of a product is ensured, and in a process of using the product, the circumstance that the lifting heights of the two ends of the product are not consistent during lifting to cause inclination of the product is avoided. The number of the driver of the present invention is one, lifting of the two ends of the synchronizing mechanism can be driven through one driver, the structure is simple, and furthermore, the cost is reduced.

Figure 1:
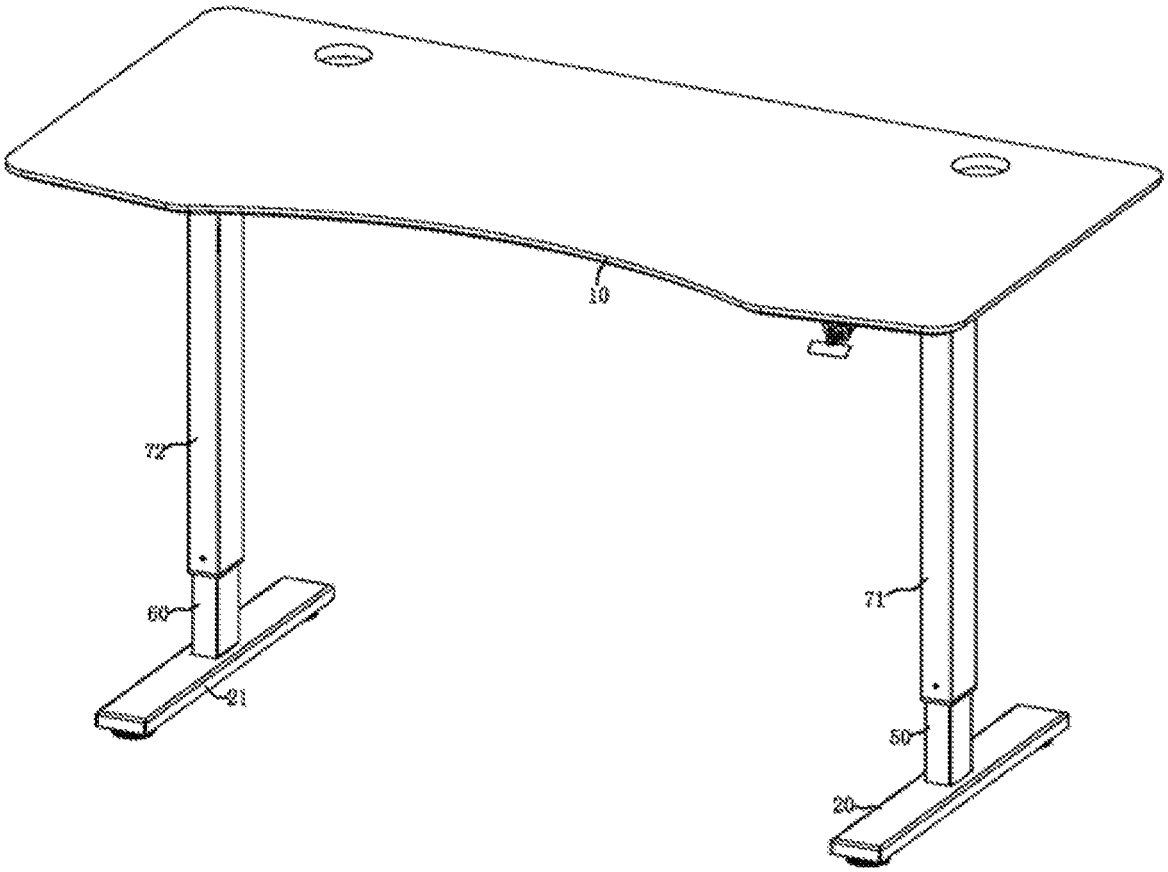
FIG. 1 is a structure diagram of a table of the present invention.

Reference numerals in FIG. 1 to FIG. 15 are shown below:

10 represents a tabletop;

20 represents a first supporting component, and 21 represents a second supporting component;

30 represents a driver, 301 represents a first shaft, and 311 represents a second shaft;

40 represents a first support, 401 represents a first hole, 411 represents a first support body, 412 represents a first rotating component, 413 represents a second rotating component, and 414 represents a third rotating component;

41 represents a second support, 410 represents a second hole, 421 represents a second support body, 422 represents a fourth rotating component, 423 represents a fifth rotating component, and 424 represents a sixth rotating component;

42 represents a first flexible traction component;

43 represents a second flexible traction component;

50 represents a first inner fixed tube, 50*a* represents a first inner tube, 51 represents a first connector, 510 represents a first U-shaped connecting portion, and 511 represents a first bent connecting portion;

60 represents a second inner fixed tube, 60*a* represents a second inner tube, 61 represents a second connector, 610 represents a second U-shaped connecting portion, and 611 represents a second bent connecting portion;

70 represents a power transmission component, 70*a* represents a side wall, 70*b* represents a bottom wall, 70*c* represents a groove, and 70*d* represents an opening;

71 represents a first movable outer tube, and 72 represents a second movable outer tube; and

80 represents a first sliding guide assembly.

DETAILED DESCRIPTION OF THE INVENTION

Figure 2:
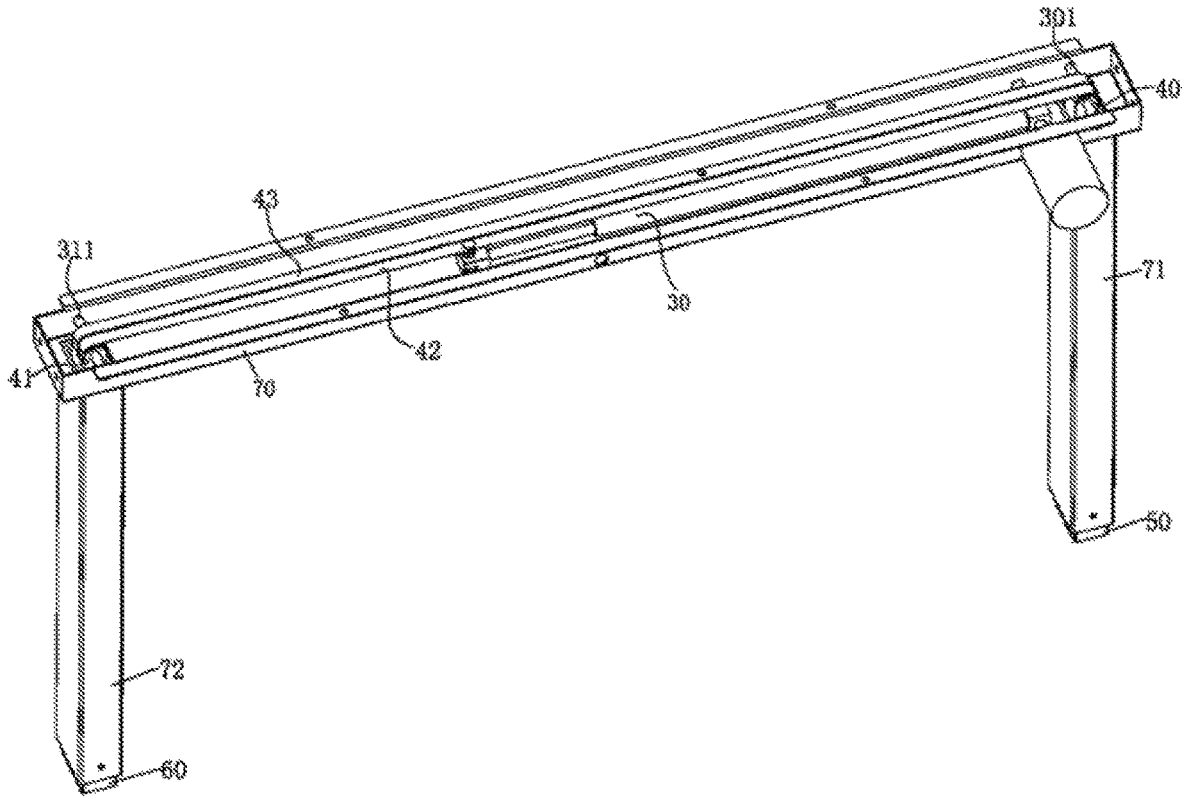
FIG. 2 is a schematic diagram of a first synchronous lifting mechanism of the present invention after a tabletop is concealed on the basis of FIG. 1.

According to a lifting table as shown in FIG. 1, as shown in FIG. 1 and FIG. 2, in one or more embodiments, the table comprises a tabletop 10, a first supporting component 20, a second supporting component 21 and a synchronous lifting mechanism, the tabletop 10 is mounted on the upper portion of the synchronous lifting mechanism, and the first supporting component 20 and the second supporting component 21 are separately connected with the lower portion of the synchronous lifting mechanism.

As shown in FIG. 2, the synchronous lifting mechanism comprises a first inner fixed tube 50, a second inner fixed tube 60 and a synchronizing mechanism, the synchronizing mechanism comprises a first support 40, a second support 41, a power transmission component 70, a first flexible traction component 42, a second flexible traction component 43 and a driver 30, and the various portions and their relationships are illustrated in detail below.

Figure 3:
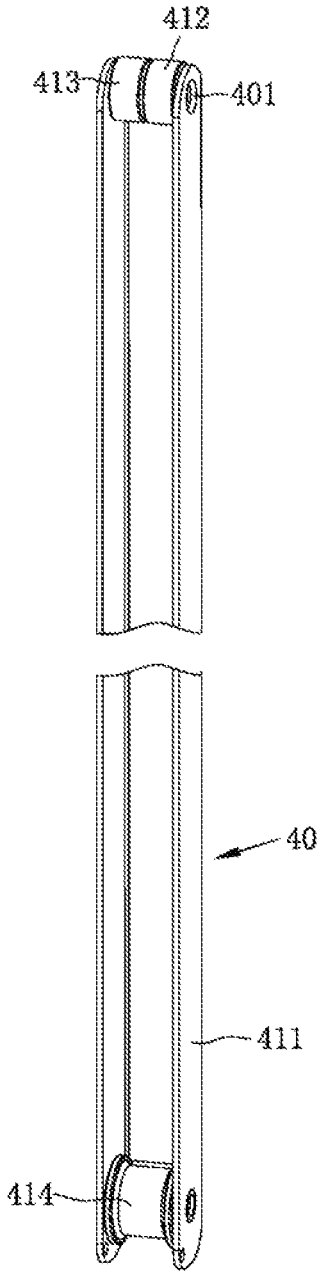
FIG. 3 is a schematic diagram of a first support.

As shown in FIG. 2 and FIG. 3, one end of the first support 40 is in clearance fit with the inside of the first inner fixed tube 50, and the other end of the first support 40 is exposed to the outside of the first inner fixed tube 50. The first support 40 comprises a first support body 411, a first rotating component 412, a second rotating component 413 and a third rotating component 414, wherein one end of the first support body 411 is in clearance fit with the inside of the first inner fixed tube 50, and the other end of the first support body 411 is exposed to the outside of the first inner fixed tube 50. The third rotating component 414 is rotatably mounted at one end of the first support body 411, the first rotating component 412 is rotatably mounted at the other end of the first support body 411, and the second rotating component 413 is rotatably mounted at the other end of the first support body 411. A first hole 401 is formed in the other end of the first support body 411, an end of a first shaft 301 penetrates through the first rotating component 412 and the second rotating component 413, and after penetrating through the first hole 401, the two ends of the first shaft 301 are connected with the power transmission component 70.

As shown in FIG. 2 and FIG. 3, the cross section of the first support body 411 is U-shaped, preferably, the first support body 411 is a steel channel, the first rotating component 412 and the second rotating component 413 are positioned in a groove in one end of the first support body 411, the first shaft 301 penetrates through the first rotating component 412 and the second rotating component 413, thus, the first rotating component 412 and the second rotating component 413 are supported by the first shaft 301, and the first rotating component 412 and the second rotating component 413 can rotate. The third rotating component 414 is positioned in a groove in the other end of the first support body 411, the third rotating component 414 is supported through a first mandrel (not shown), and thus, the third rotating component 414 can rotate. Each of the first rotating component 412, the second rotating component 413 and the third rotating component 414 is one of a bearing or a roller or a chain wheel.

Figure 4:
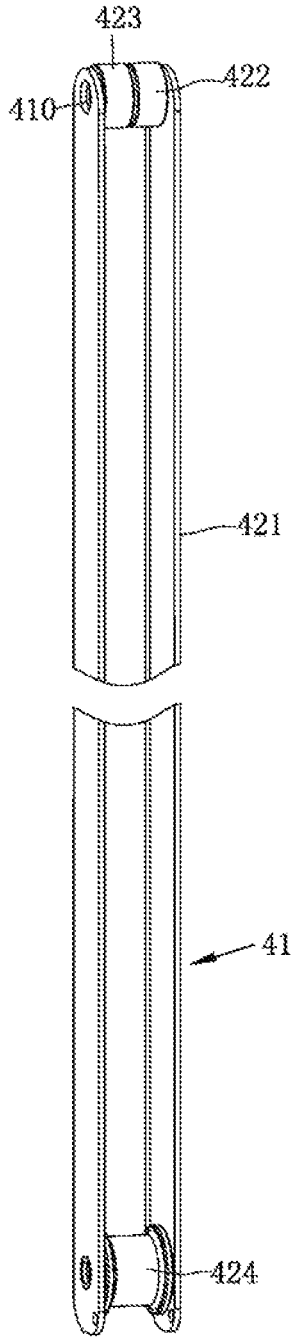
FIG. 4 is a schematic diagram of a second support.
Figure 5:
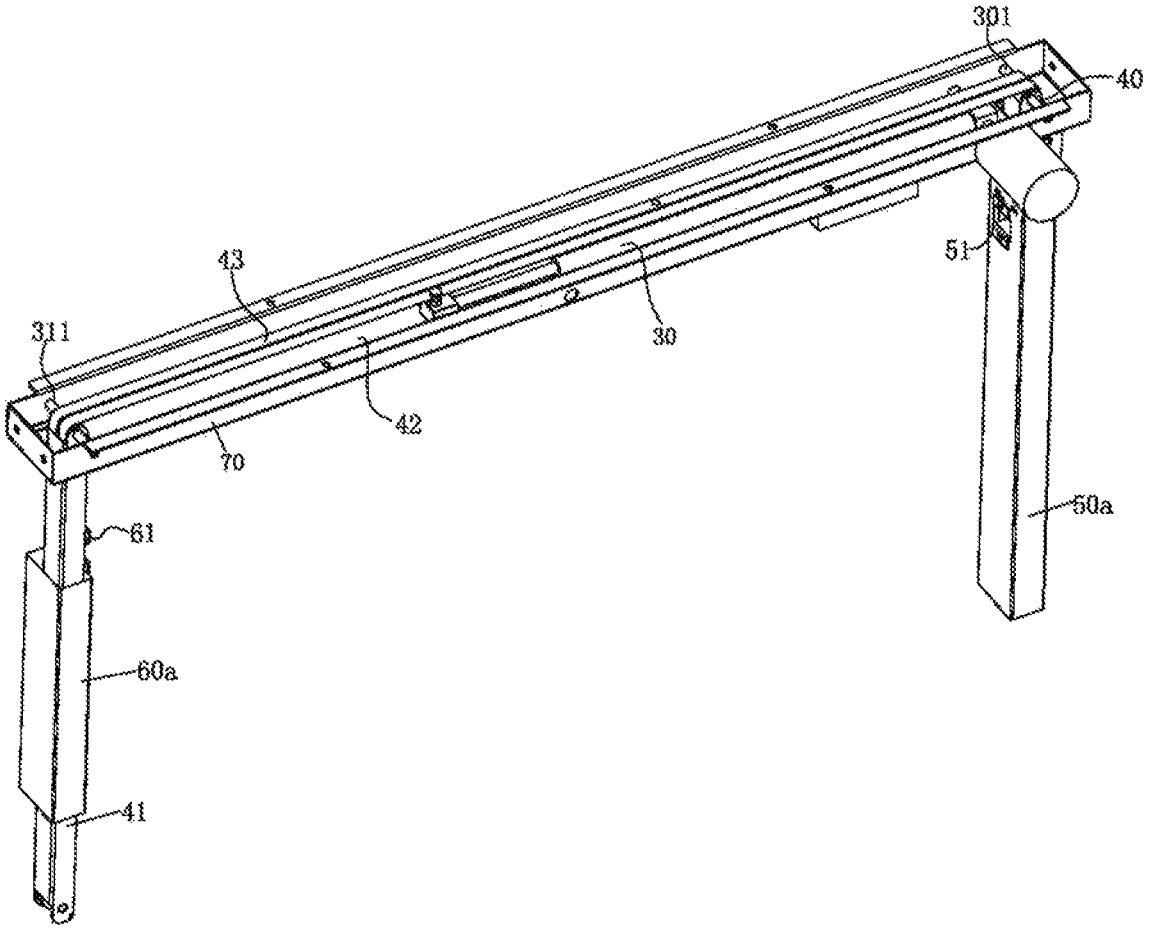
FIG. 5 a schematic diagram after a first movable outer tube, a second movable outer tube and part of a second inner tube are concealed on the basis of FIG. 2.
Figure 6:
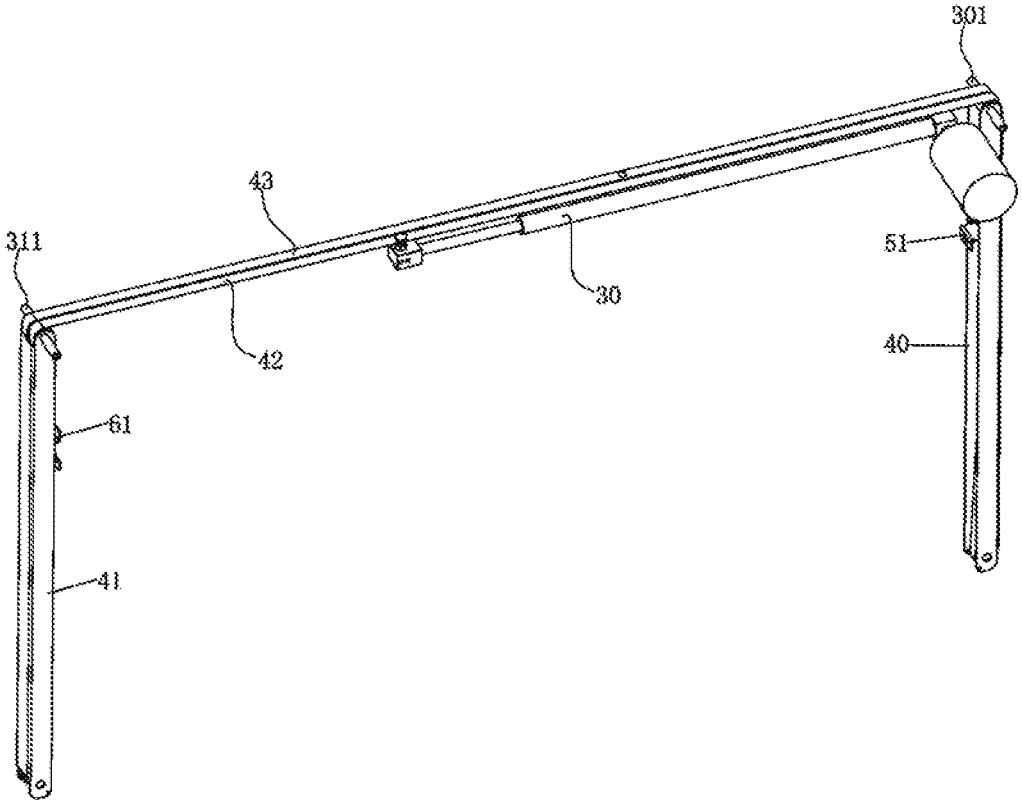
FIG. 6 is a schematic diagram after a first inner tube, the second inner tube and a power transmission component are concealed on the basis of FIG. 5.
Figure 7:
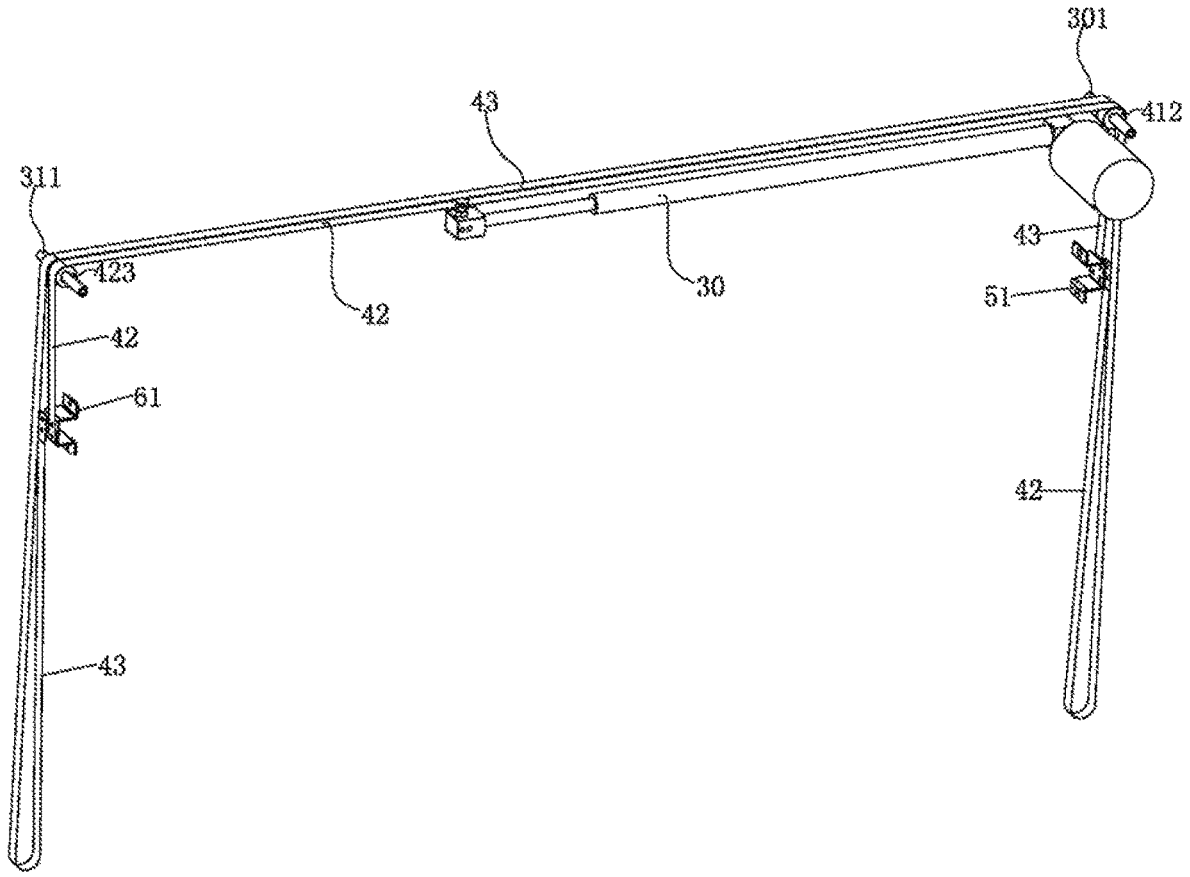
FIG. 7 is a schematic diagram after the first support and the second support are concealed on the basis of FIG. 6.
Figure 8:
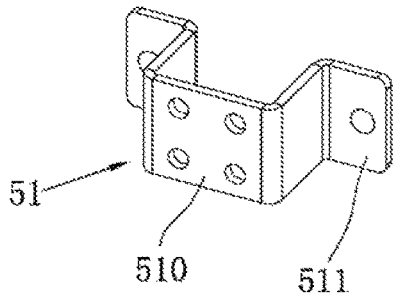
FIG. 8 is a schematic diagram of a first connector.
Figure 9:
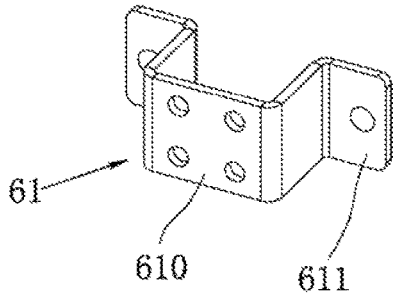
FIG. 9 is a schematic diagram of a second connector.
Figure 10:
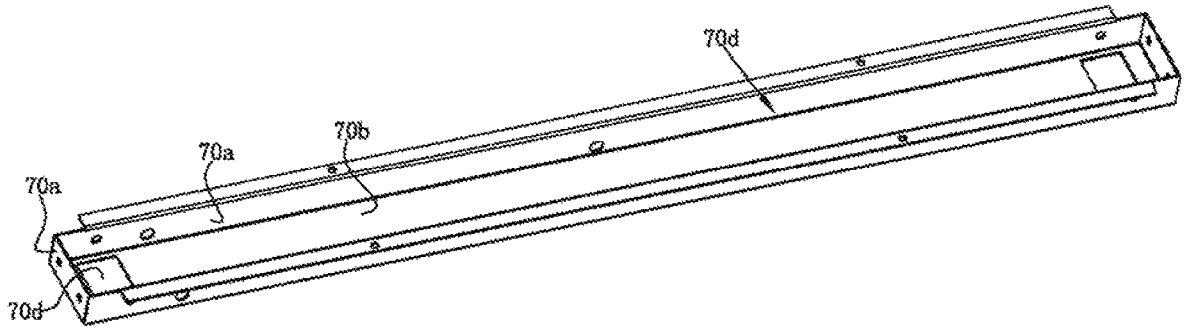
FIG. 10 is a schematic diagram of the power transmission component as shown in FIG. 2.
Figure 11:
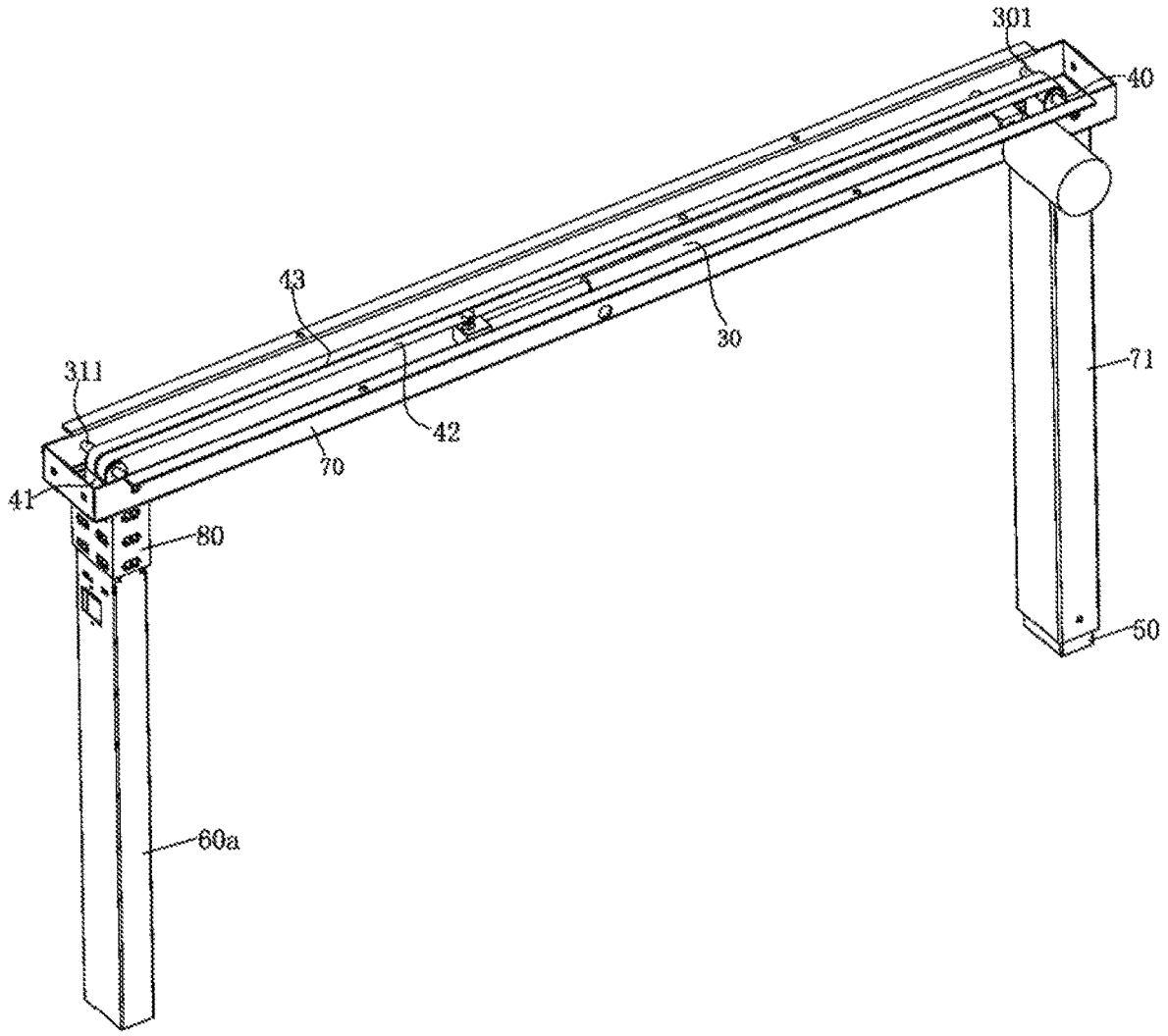
FIG. 11 is a schematic diagram after the second movable outer tube is concealed on the basis of FIG. 2.

As shown in FIG. 2 and FIG. 4, one end of the second support 41 is in clearance fit with the inside of the second inner fixed tube 60, and the other end of the second support 41 is exposed to the outside of the first inner fixed tube 60. The second support 42 comprises a second support body 421, a fourth rotating component 422, a fifth rotating component 423 and a sixth rotating component 424, wherein one end of the second support body 421 is in clearance fit with the inside of the second inner fixed tube 60, and the other end of the second support body 421 is exposed to the outside of the second inner fixed tube 60. The sixth rotating component 424 is rotatably mounted at one end of the second support body 421, the fourth rotating component 422 is rotatably mounted at the other end of the second support body 421, and the fifth rotating component 423 is rotatably mounted at the other end of the second support body 421. A second hole 410 is formed in the other end of the second support body 421, an end of a second shaft 311 penetrates through the fourth rotating component 422 and the fifth rotating component 423, and after penetrating through the second hole 410, the two ends of the second shaft 311 are connected with the power transmission component 70.

As shown in FIG. 2 and FIG. 4, the cross section of the second support body 421 is U-shaped, preferably, the second support body 421 is a steel channel, the fourth rotating component 422 and the fifth rotating component 423 are both positioned in a groove in one end of the second support body 421, the second shaft 311 penetrates through the fourth rotating component 422 and the fifth rotating component 423, thus, the fourth rotating component 422 and the fifth rotating component 423 are supported by the second shaft 311, and the fourth rotating component 422 and the fifth rotating component 423 can rotate. The sixth rotating component 424 is positioned in a groove in the other end of the second support body 421, the sixth rotating component 424 is supported through a second mandrel, and thus, the sixth rotating component 424 can rotate. Each of the fourth rotating component 422, the fifth rotating component 423 and the sixth rotating component 424 is one of a bearing or a roller or a chain wheel.

As shown in FIG. 2 to FIG. 9, one end of the first flexible traction component 42 is fixedly connected with the second inner fixed tube 60, and after the first flexible traction component 42 is flexibly matched with one end of the second support 41, one end of the first support 40 and the other end of the first support 40, the other end of the first flexible traction component 42 is fixedly connected with the first inner fixed tube 50. Preferably, the first flexible traction component 42 is flexibly matched with the fifth rotating component 423, the first rotating component 412 and the third rotating component 414, and the mode of flexible matching is similar to a mode of matching a belt with a belt pulley, namely the first flexible traction component 42 is tensioned by the fifth rotating component 423, the first rotating component 412 and the third rotating component 414.

As shown in FIG. 2 to FIG. 9, one end of the second flexible traction component 43 is fixedly connected with the first inner fixed tube, and after the second flexible traction component 42 is flexibly matched with one end of the first support 40, one end of the second support 41 and the other end of the second support 41, the other end of the second flexible traction component 43 is fixedly connected with the second inner fixed tube. The second flexible traction component is flexibly matched with the second rotating component 413, the fourth rotating component 422 and the sixth rotating component 424, and the mode of flexible matching is similar to the mode of matching a belt with a belt pulley, namely, the second flexible traction component 43 is tensioned by the sixth rotating component 424, the second rotating component 413 and the fourth rotating component 422.

As shown in FIG. 2 to FIG. 9, the first inner fixed tube 50 comprises a first inner tube 50*a* and a first connector 51, one end of the first inner tube 50*a* is fixed to a first supporting component 20, at least one part of the first connector 51 is positioned in the first inner tube 50*a* and is fixed to the first inner tube 50*a*, the first connector 51 consists of a first U-shaped connecting portion 510 and first bent connecting portions 511 formed by bending the two ends of the first U-shaped connecting portion 510, a first through hole is formed in the wall of the first inner tube 50*a*, the first U-shaped connecting portion 510 penetrates through the first through hole and is positioned in the first inner tube 50*a*, and the first bent connecting portions 511 are positioned on the outside of the first inner tube 50*a* and are fixedly connected with the first inner tube 50*a*.

As shown in FIG. 2 to FIG. 9, the second inner fixed tube 60 comprises a second inner tube 60*a* and a second connector 61, at least one part of the second connector 61 is positioned in the second inner tube 60*a* and is fixed to the second inner tube 60*a*, the second connector 61 consists of a second U-shaped connecting portion 610 and second bent connecting portions 611 formed by bending the two ends of the second U-shaped connecting portion 610, a second through hole is formed in the wall of the second inner tube 60*a*, the second U-shaped connecting portion 610 is positioned in the second inner tube 60*a* via the second through hole, and the second bent connecting portions 611 are positioned on the outside of the second inner tube 60*a* and are fixedly connected with the second inner tube 60*a*.

As shown in FIG. 2 to FIG. 9, one end of the first flexible traction component 42 is fixedly connected with the second connector 61, the other end of the first flexible traction component 42 is fixedly connected with the first connector 51, one end of the second flexible traction component 43 is fixedly connected with the first connector 51, and the other end of the second flexible traction component 43 is fixedly connected with the second connector 61. Preferably, one end of the first flexible traction component 42 is fixedly connected with the second U-shaped connecting portion 610 of the second connector 61 through a screw or a pin, the other end of the first flexible traction component 42 is fixedly connected with the first U-shaped connecting portion 510 of the first connector 51 through a screw or a pin, one end of the second flexible traction component 43 is fixedly connected with the first U-shaped connecting portion 510 of the first connector 51 through a screw or a pin, and the other end of the second flexible traction component 43 is fixedly connected with the second U-shaped connecting portion 610 of the second connector 61 through a screw or a pin.

As shown in FIG. 2 to FIG. 9, the first flexible traction component 42 and the second flexible traction component 43 are one of rope-shaped components or band-shaped components or steel wires or chains separately. When the first flexible traction component 42 and the second flexible traction component 43 are rope-shaped components or the band-shaped components or the steel wires, the first rotating component 412, the second rotating component 413, the third rotating component 414, the fourth rotating component 422, the fifth rotating component 423 and the sixth rotating component 424 are bearings or rollers, and grooves are formed in the outer peripheral surfaces of the bearings or rollers, and are matched with the first flexible traction component 42 and the second flexible traction component 43.

When the first flexible traction component 42 and the second flexible traction component 43 are chains, the first rotating component 412, the second rotating component 413, the third rotating component 414, the fourth rotating component 422, the fifth rotating component 423 and the sixth rotating component 424 are chain wheels.

As shown in FIG. 2 to FIG. 9, the power transmission component 70 stretches across the first support 40 and the second support 41, one end of the power transmission component 70 is connected with the other end of the first support 40, the other end of the power transmission component 70 is connected with the other end of the second support 41, when the driver 30 drives the first flexible traction component 42 or the second flexible traction component 43 or the first support 40 or the second support 41 to move, for example, the driver 30 drives the first flexible traction component 42 to move to enable the first support 40 to ascend, at the moment, the first support 40 drives the end, which is connected with the first support 40, of the power transmission component 70 to ascend, thus, the power transmission component 70 ascends integrally, namely the other end of the power transmission component 70 also ascends, at the moment, the power transmission component 70 drives the second support 41 to ascend, and the second support 41 drives the second flexible traction component 43 to move. Therefore, only one driver 30 is used in the present invention, when the output end of the driver 30 has power, the first support 40 and the second support 41 may ascend or descend through the relationship between the power transmission component 70, the first flexible traction component 42, the second flexible traction component 43, the first support 40 and the second support 41, and obviously, the power transmission component 70 has a power transmitting effect.

As shown in FIG. 2 to FIG. 10, the power transmission component 70 comprises side walls 70*a* and a bottom wall 70*b*, preferably, the number of the side walls 70*a* is 4, the four side walls 70*a* and the bottom wall 70*b* define a groove 70*c* in a surrounding manner, openings 70*d* are formed in the two ends of the bottom wall, and the two openings 70*d* separately provide accommodation for the first support 40, the second support 41, the first flexible traction component 42 and the second flexible traction component 43 during movement. The formed groove 70*c* can accommodate the first flexible traction component 42 and the second flexible traction component 43, so that the first flexible traction component 42 and the second flexible traction component 43 cannot be seen from the outside.

As shown in FIG. 2 to FIG. 9, the driver 30 is arranged on the power transmission component 70, and the power output of the driver 30 is connected with the first flexible traction component 42 or the second flexible traction component 43; and the driver 30 mounted on the power transmission component 70 is a telescopic driver or a linear driver. The driver 30 as shown in FIG. 2 is a linear driver, the linear driver is a linear actuator, the linear actuator comprises a motor, a gear box and a lead screw mechanism, the gear box comprises a box body, a first bevel gear and a second bevel gear, the first bevel gear and the second bevel gear are mounted in the box body, the first bevel gear is engaged with the second bevel gear, the output end of the motor is connected with the first bevel gear, one end of a lead screw in the lead screw mechanism is connected with the second bevel gear, a nut in the lead screw mechanism is in threaded fit with the lead screw in the lead screw mechanism, and the nut in the lead screw mechanism is connected with the first flexible traction component 42 or the second flexible traction component 43. The linear actuator further comprises a power supply and a switch, the power supply is connected with the switch, the switch is connected with the motor, the switch controls the motor to forwards rotate or reversely rotate, and therefore, lifting of the synchronizing mechanism is controlled.

Figure 14:
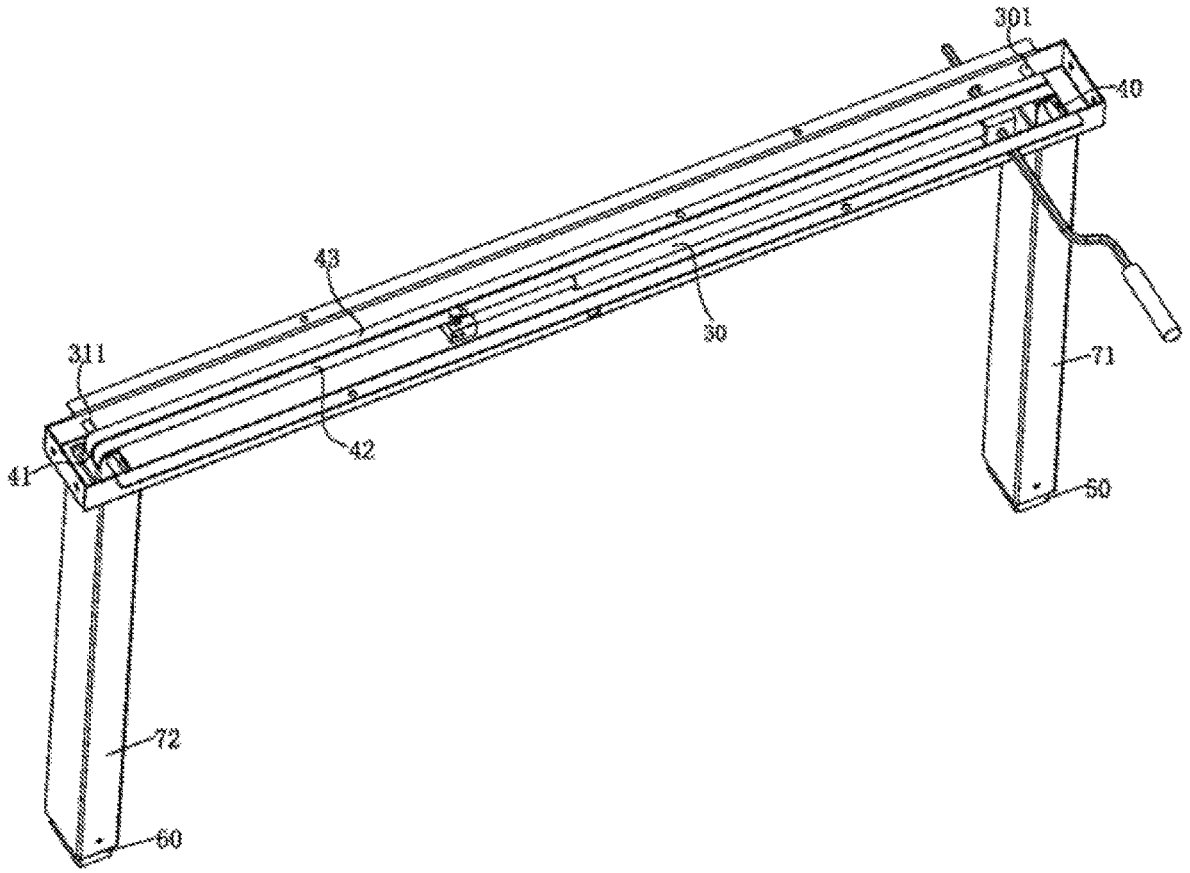
FIG. 14 is a schematic diagram of a fourth synchronous lifting mechanism of the present invention.

In addition, the linear driver can also a hand push rod, in the hand push rod, a handle replaces the motor (as shown in FIG. 14) in the linear actuator, the handle forwards rotates or reversely rotates to control lifting of the synchronizing mechanism, and the rest structures in the hand push rod are the same as the rest structures in the linear actuator.

The linear driver can further consist of a motor and a lead screw mechanism connected to the output end of the motor, one end of a lead screw in the lead screw mechanism is connected with the output end of the motor, a nut in the lead screw mechanism is in threaded fit with the lead screw in the lead screw mechanism, and the nut in the lead screw mechanism is connected with the first flexible traction component 42 or the second flexible traction component 43.

Figure 13:
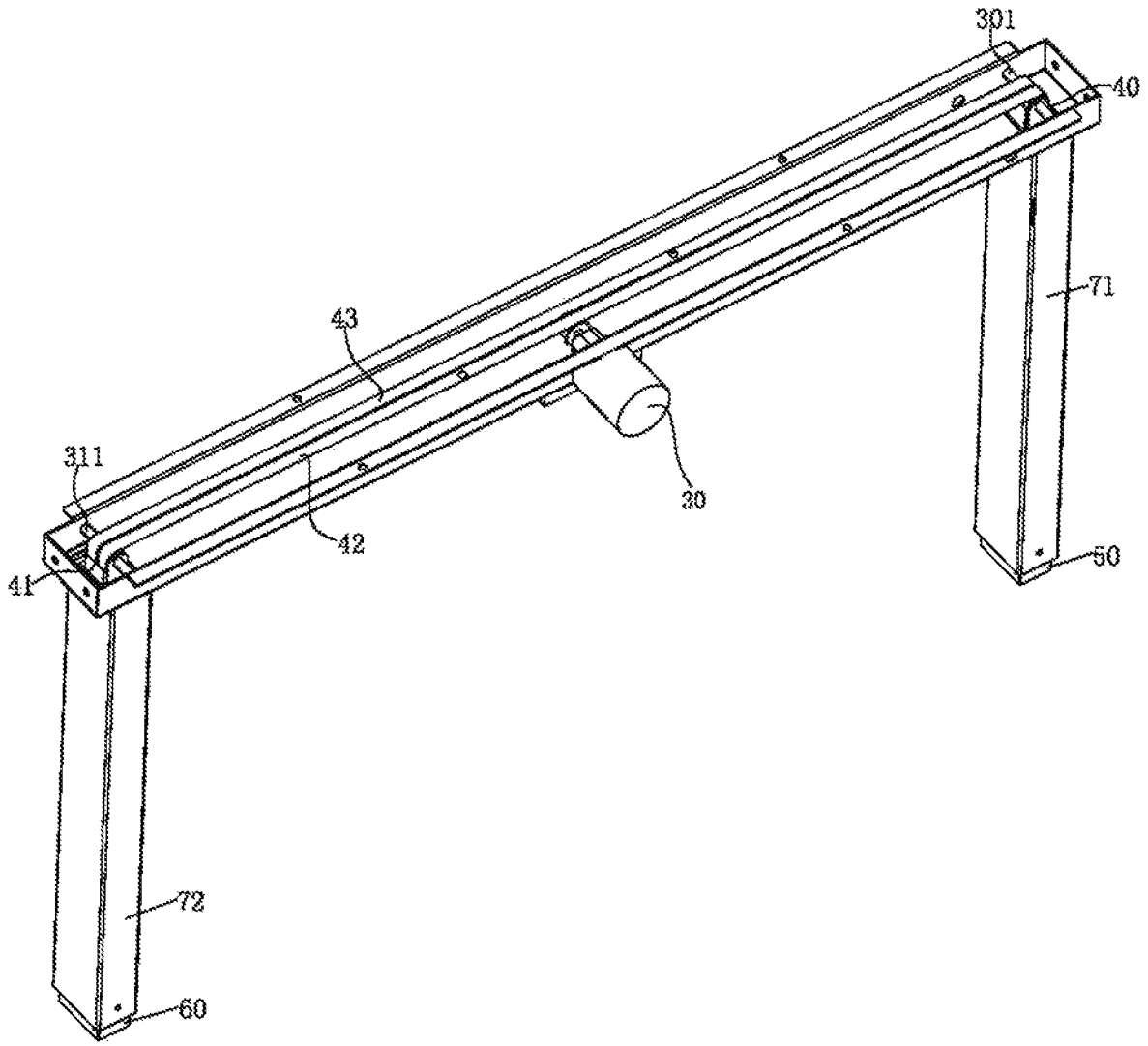
FIG. 13 is a schematic diagram of a third synchronous lifting mechanism of the present invention.

The linear driver can further consist of a motor and a gear, wherein the gear is connected to the output end of the motor (as shown in FIG. 13), teeth are arranged on the first flexible traction component 42 or on the surface of the first flexible traction component 42, and the teeth are engaged with teeth on the gear to form a gear and rack transmission structure.

The linear driver can further consist of a motor and a transmission wheel, wherein a friction wheel is connected to the output end of the motor, the first flexible traction component 42 or the second flexible traction component 43 are wound around the transmission wheel by one circle, but wound portions are not superposed.

The linear driver can further be a linear cylinder.

Figure 12:
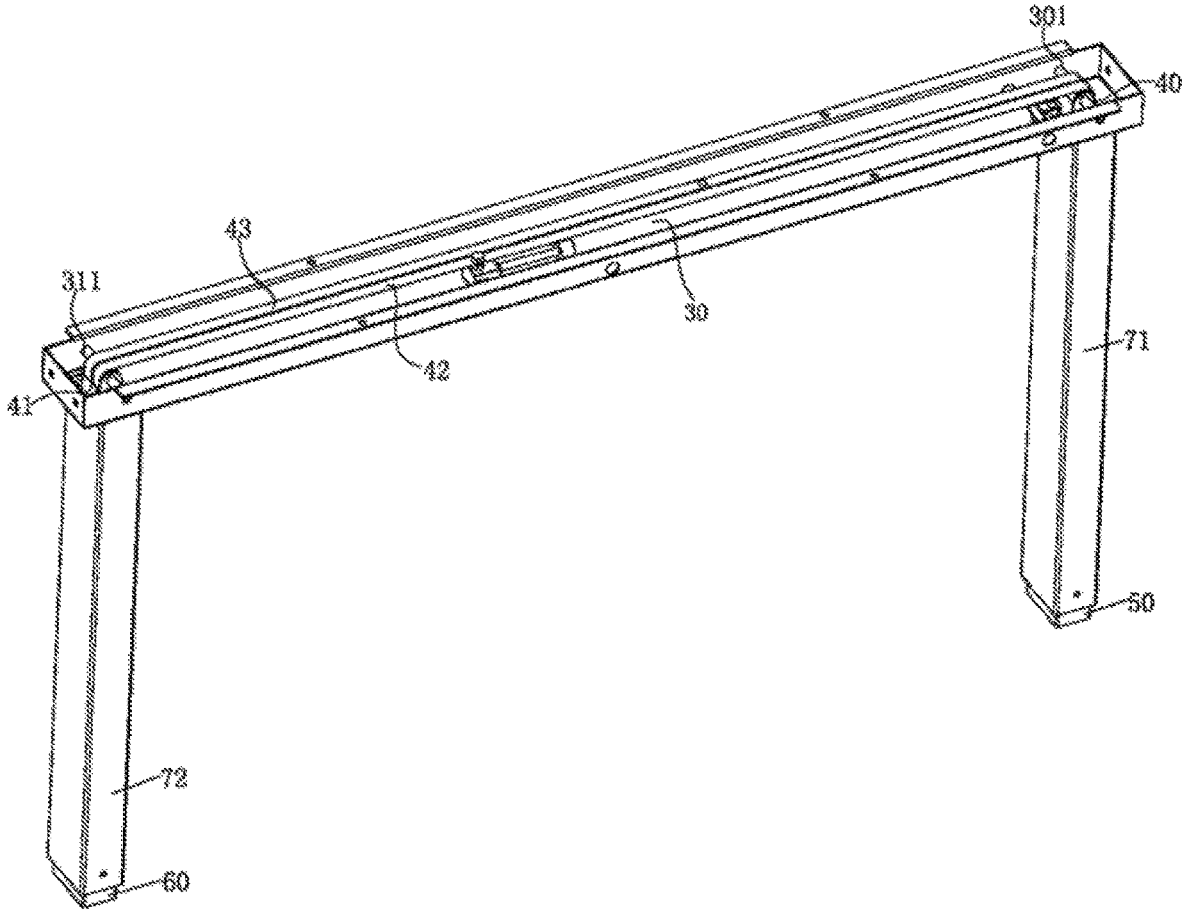
FIG. 12 is a schematic diagram of a second synchronous lifting mechanism of the present invention.

The telescopic driver can be an air spring (as shown in FIG. 12), an air cylinder, an oil cylinder and the like.

Figure 15:
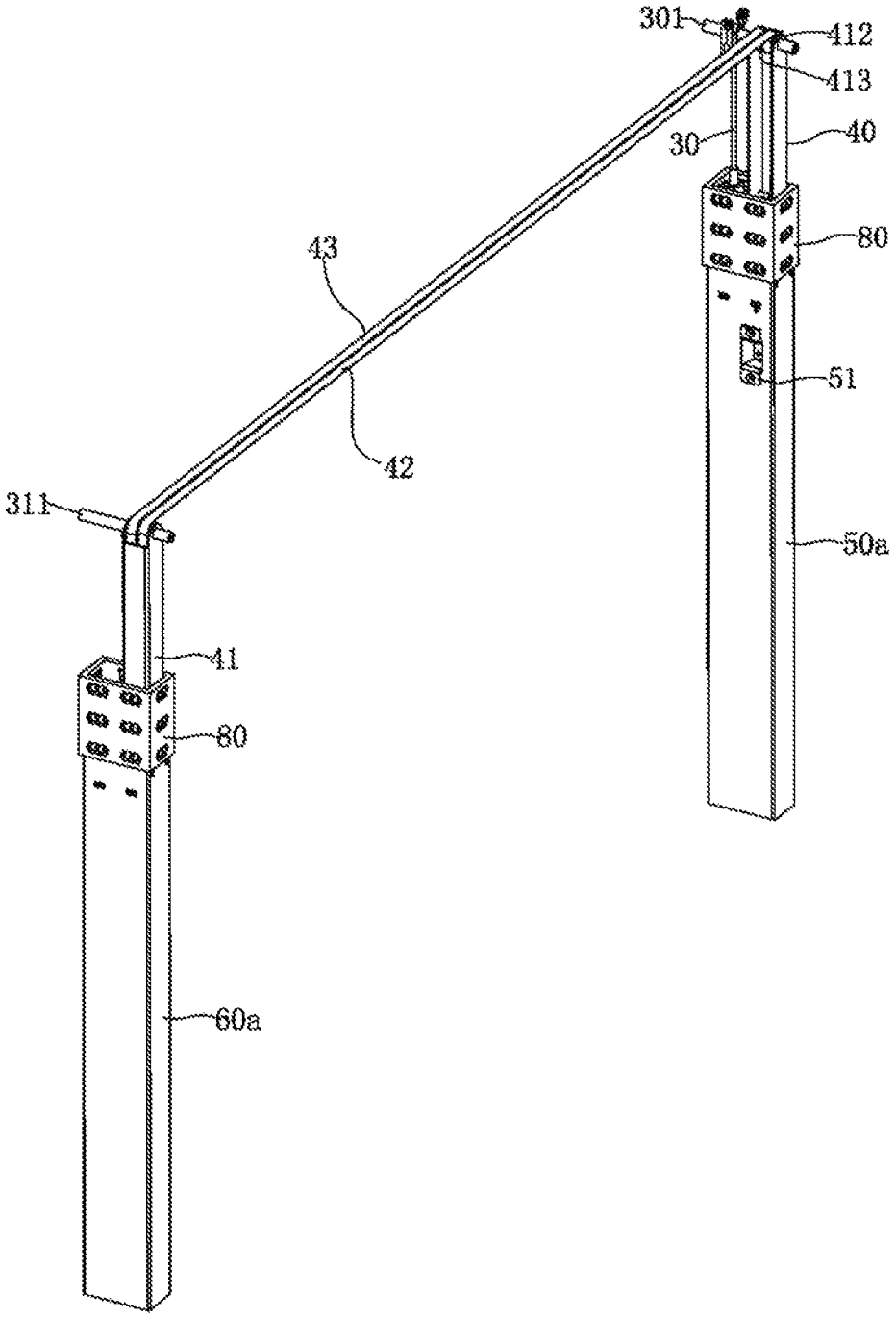
FIG. 15 is a schematic diagram of the fourth synchronous lifting mechanism of the present invention.

As shown in FIG. 15, at least one part of the driver 30 is arranged in the first inner fixed tube 50, the power output end of the driver 30 is connected with the other end of the first support 40 or the power transmission component 70 or the first flexible traction component 42; or at least one part of the driver 30 is arranged in the second inner fixed tube 60, and the power output end of the driver 30 is connected with the other end of the second support 41 or the power transmission component 70 or the second flexible traction component 43. The driver which is positioned in the first inner fixed tube 50 or the second inner fixed tube 60 not only can be a telescopic driver, but also can be a linear driver. The telescopic driver can be an air spring, an air cylinder, an oil cylinder and the like, and the linear driver can be a linear actuator and the like. The driver 30 in FIG. 15 is an air spring.

The cross section of the first support body 411 and the cross section of the second support body 421 are U-shaped, therefore, the driver 30 not only can be accommodated in the first support body 411 and the second support body 421, but also can be positioned on the outside of the first support body 411 or the outside of the second support body 421, when the driver 30 is positioned on the outside of the first support body 411 or the outside of the second support body 421, an elongated hole is formed in the side wall of the first support body 411 or the second support body 421, and the power output end of the driver 30 penetrates through the elongated hole and is connected with the first flexible traction component 42 or the second flexible traction component 43.

As shown in FIG. 2 to FIG. 11, the synchronous lifting mechanism further comprises a first movable outer tube 71, one end of the first movable outer tube 71 is fixed to one end of the power transmission component 70, and the first movable outer tube 71 lifts along with lifting of the power transmission component 70. The first movable outer tube 71 is sleeved over the first inner fixed tube 50, namely the first movable outer tube 71 is sleeved over the first inner tube 50*a*. A first sliding guide assembly 80 is arranged between the first movable outer tube 71 and the first inner tube 50*a*; and preferably, the first sliding guide assembly 80 is mounted on the first inner tube 50*a*, is fixed on the outer peripheral surface of the other end of the first inner tube 50*a*, is matched with the inner wall surface of the first movable outer tube 71, and guides lifting of the first movable outer tube 71. The structure of the first sliding guide assembly 80 is the same as the structure of a rolling friction assembly disclosed in the patent with the publication number being CN106308039A, and thus, the descriptions thereof are omitted herein.

As shown in FIG. 2 to FIG. 11, the synchronous lifting mechanism further comprises a second movable outer tube 72, one end of the second movable outer tube 72 is fixed to the other end of the power transmission component 70, and the second movable outer tube 72 lifts along with lifting of the power transmission component 70. The second movable outer tube 72 is sleeved over the second inner fixed tube 60, namely the second movable outer tube 72 is sleeved over the second inner tube 60*a*. A second sliding guide assembly is arranged between the first movable outer tube 71 and the first inner tube 50*a*; and preferably, the second sliding guide assembly is fixed on the outer peripheral surface of the other end of the second inner tube 60*a*, is matched with the inner wall surface of the second movable outer tube 72, and guides lifting of the second movable outer tube 72. The structure of the second sliding guide assembly is the same as that of the first sliding guide assembly 80, and thus, the descriptions thereof are omitted herein.

As shown in FIG. 2 to FIG. 11, when the first support 40 and the second support 41 lift, the first movable outer tube 71 shields the first support 40, the second movable outer tube 72 shields the second support 41, and therefore, the circumstance that the first support 40 and the second support 41 are exposed to the outside to affect attractiveness can be avoided.

In a working process of the present invention, the up-down direction and the left-right direction which are involved below are observation directions from the locations in the drawings, and do not limit the claims.

The driver as shown in FIG. 2 to FIG. 11 is described as an example. In an ascending process, the driver 30 works, the push rod of the driver 30 extends out to drive the first flexible traction component 42 to move leftwards, the power of the first flexible traction component 42 acts on the first support body 411 to enable the first support body 411 to ascend, the first support body 411 drives one end of the power transmission component 70 to ascend, thus, the power transmission component 70 ascends integrally, namely, the other end of the power transmission component 70 also ascends, the second support body 421 is driven to ascend through the power transmission component 70, and the second support body 421 drives the second flexible traction component 43 to move rightwards. In a descending process, the push rod of the driver 30 retracts, one end of the first flexible traction component 42 is fixed to the second connector 61 so that the portion, which is flexibly matched with the second support body 421, of the first flexible traction component 42 is forced to move rightwards, the power of the first flexible traction component 42 acts on the first support body 411 to enable the first support body 411 to descend, the first support body 411 drives one end of the power transmission component 70 to descend, thus, the power transmission component 70 descends integrally, namely, the other end of the power transmission component 70 also descends, the second support body 421 is driven to descend through the power transmission component 70, and the second support body 421 drives the second flexible traction component 43 to move leftwards.

The present invention is not limited to the above embodiments, for example, two ends of the first support 40 and two ends of the second support 41 are arc-shaped, and the first flexible traction component 42 and the second flexible traction component 43 are separately matched with the upper end of the first support and the upper end of the second support. In the mode, the first rotating component 412, the second rotating component 413 and the third rotating component 414 do not need to be mounted on the first support 40, and the fourth rotating component 422, the fifth rotating component 423 and the sixth rotating component 424 do not need to be mounted on the second support 41 either. By the mode, when the first flexible traction component 42 and the second flexible traction component 43 are band-shaped components or rope-shaped components, the first flexible traction component 42 is in surface contact with the first support 40 and the second support 41, and when the first flexible traction component 42 moves, surface-to-surface frictional forces are formed between the first flexible traction component 42 and the first support 40 as well as the second support 41 and between the second flexible traction component 43 and the first support 40 as well as the second support 41. When the first flexible traction component 42 and the second flexible traction component 43 are steel wires, the first flexible traction component 42 is in wire-surface contact with the first support 40 and the second support 41, and when the first flexible traction component 42 moves, wire-to-surface frictional forces are formed between the first flexible traction component 42 and the first support 40 as well as the second support 41 and between the second flexible traction component 43 and the first support 40 as well as the second support 41. In the mode, regardless of whether the first flexible traction component 42 and the second flexible traction component 43 are band-shaped components or the rope-shaped components or the steel wires, during movement of the first flexible traction component 42 and the second flexible traction component 43, the frictional forces between the first flexible traction component 42 and the first support 40 as well as the second support 41 and between the second flexible traction component 43 and the first support 40 as well as the second support 41 are greater than frictional forces in the first embodiment, and therefore, the structure in which the rotating components are arranged at the ends of the supports is adopted preferably in actual use.

In addition, the first support body 411 and the second support body 421 can be also welded to the power transmission component 70.

The embodiments illustrate that the synchronous lifting device of the present invention is suitable for a table, however, the synchronous lifting device of the present invention is not limited to be used on the table, and it can further be used on a chair or used in a situation requiring lifting.

We claim:

1. A synchronous lifting mechanism, comprising a first inner fixed tube and a second inner fixed tube, wherein the synchronous lifting mechanism further comprises a synchronizing mechanism, the synchronizing mechanism comprises:

a first support, one end of the first support is in clearance fit with the inside of the first inner fixed tube;

a second support, one end of the second support is in clearance fit with the inside of the second inner fixed tube;

a power transmission component stretching across the first support and the second support, wherein one end of the power transmission component is connected with the other end of the first support, and the other end of the power transmission component is connected with the other end of the second support;

a first flexible traction component, wherein one end of the first flexible traction component is connected with the second inner fixed tube, and after the first flexible traction component is flexibly matched with one end of the second support, one end of the first support and the other end of the first support, the other end of the first flexible traction component is connected with the first inner fixed tube;

a second flexible traction component, wherein one end of the second flexible traction component is connected with the first inner fixed tube, and after the second flexible traction component is flexibly matched with one end of the first support, one end of the second support and the other end of the second support, the other end of the second flexible traction component is connected with the second inner fixed tube;

a driver arranged on the power transmission component, wherein the power output of the driver is connected with the first flexible traction component or the second flexible traction component; or at least one part of the driver is arranged in the first inner fixed tube, and the power output end of the driver is connected with the other end of the first support or the power transmission component or the first flexible traction component; or at least one part of the driver is arranged in the second inner fixed tube, and the power output end of the driver is connected with the other end of the second support or the power transmission component or the second flexible traction component; and wherein, the first inner fixed tube comprises a first inner tube and a first connector, the first connector is positioned in the first inner tube and is fixed to the first inner tube, the other end of the first flexible traction component is fixedly connected with the first connector, and one end of the second flexible traction component is fixedly connected with the first connector.

2. The synchronous lifting mechanism according to claim 1, wherein the first support comprises:

a first support body;

a first rotating component rotatably mounted at one end of the first support body;

a second rotating component rotatably mounted at one end of the first support body; and a third rotating component rotatably mounted at the other end of the first support body.

3. The synchronous lifting mechanism according to claim 1, wherein the second inner fixed tube comprises a second inner tube and a second connector, the second connector is positioned in the second inner tube and is fixed to the second inner tube, one end of the first flexible traction component is fixedly connected with the second connector, and the other end of the second flexible traction component is fixedly connected with the second connector.

4. The synchronous lifting mechanism according to claim 1, wherein the second support comprises: a second support body;

a fourth rotating component rotatably mounted at one end of the second support body;

a fifth rotating component rotatably mounted at one end of the second support body; and a sixth rotating component rotatably mounted at the other end of the second support body;

wherein the first flexible traction component is flexibly matched with the fifth rotating component, the first rotating component and the third rotating component; and the second flexible traction component is matched with the second rotating component, the fourth rotating component and the sixth rotating component.

5. The synchronous lifting mechanism according to claim 1, wherein the first flexible traction component and the second flexible traction component are both flexible components.

6. The synchronous lifting mechanism according to claim 1, wherein the first flexible traction component and the second flexible traction component are one of rope-shaped components or band-shaped components or steel wires or chains separately.

7. The synchronous lifting mechanism according to claim 1, wherein the driver mounted on the power transmission component is a telescopic driver or a linear driver.

8. The synchronous lifting mechanism according to claim 1, further comprising:

a first movable outer tube, wherein one end of the first movable outer tube is fixed to one end of the power transmission component, and the first movable outer tube is sleeved over the first inner fixed tube; and a second movable outer tube, wherein one end of the second movable outer tube is fixed to the other end of the power transmission component, and the second movable outer tube is sleeved over the second inner fixed tube.

9. The synchronous lifting mechanism according to claim 1, wherein a number of the driver is one.

* * * * *